US006260534B1

(12) United States Patent
Kampichler et al.

(10) Patent No.: US 6,260,534 B1
(45) Date of Patent: Jul. 17, 2001

(54) OIL PICKUP SYSTEM FOR AN INTERNAL COMBUSTION ENGINE, NOTABLY A SINGLE-CYLINDER DIESEL ENGINE

(75) Inventors: Guenter Kampichler, Ruhstorf/Rott; Albert Madl, Stubenberg, both of (DE)

(73) Assignee: Motorenfabrik Hatz GmbH & Co. KG, Ruhstorf/Roh (DE)

( * ) Notice: Subject to any disclaimer, the term of this patent is extended or adjusted under 35 U.S.C. 154(b) by 0 days.

(21) Appl. No.: 09/622,315

(22) PCT Filed: Dec. 23, 1999

(86) PCT No.: PCT/EP99/10361

§ 371 Date: Sep. 15, 2000

§ 102(e) Date: Sep. 15, 2000

(87) PCT Pub. No.: WO00/39436

PCT Pub. Date: Jul. 6, 2000

(30) Foreign Application Priority Data

Dec. 28, 1998 (DE) ..... 196 80 381

(51) Int. Cl.[7] ..... F01M 11/00
(52) U.S. Cl. ..... 123/196 R
(58) Field of Search ..... 123/196 R

(56) References Cited

U.S. PATENT DOCUMENTS

| | | | | |
|---|---|---|---|---|
| 1,866,280 | | 7/1932 | Woolson . | |
| 5,136,993 | * | 8/1992 | Ampferer et al. | 123/196 R |
| 5,495,833 | * | 3/1996 | Ishizaka et al. | 123/196 R |
| 5,662,080 | * | 9/1997 | Isono et al. | 123/195 |
| 5,975,042 | * | 11/1999 | Aizawa et al. | 123/196 R |
| 6,075,495 | * | 6/2000 | Takahashi et al. | 123/196 W |

FOREIGN PATENT DOCUMENTS

| | | |
|---|---|---|
| 23 39 730 | 2/1974 | (DE) . |
| 12 38 270 | 7/1978 | (DE) . |
| 27 01 939 | 7/1978 | (DE) . |
| 27 32 474 | 2/1979 | (DE) . |
| 2 196 004 | 3/1974 | (FR) . |
| 2 639 405 | 5/1990 | (FR) . |

* cited by examiner

*Primary Examiner*—Marguerite McMahon
(74) *Attorney, Agent, or Firm*—Helfgott & Karas, P.C.

(57) ABSTRACT

The invention describes an oil-pickup system for an internal combustion engine, especially a one-cylinder diesel engine with at least three oil-pickup tubes (26, 27, 28), which are in communication with the oil pump via a suction tube (29) and which are disposed in the oil pan (24) in such a way that, if the internal combustion engine is in inclined position, intake of air is prevented by the control valves associated with the oil-pickup tubes.

6 Claims, 2 Drawing Sheets

Fig. 2
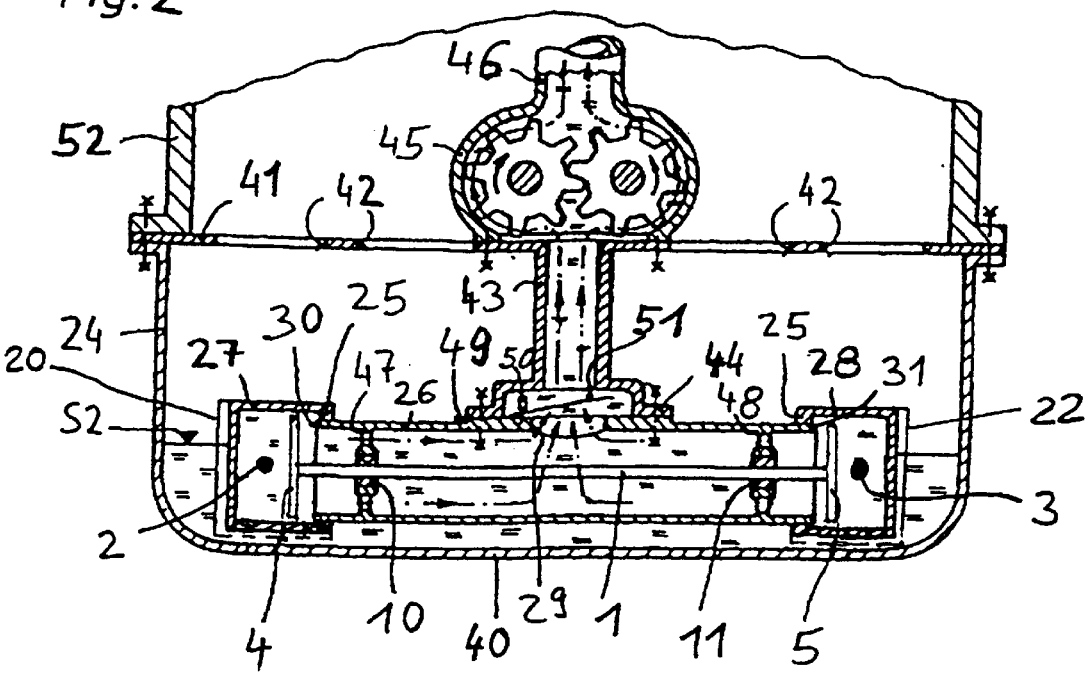
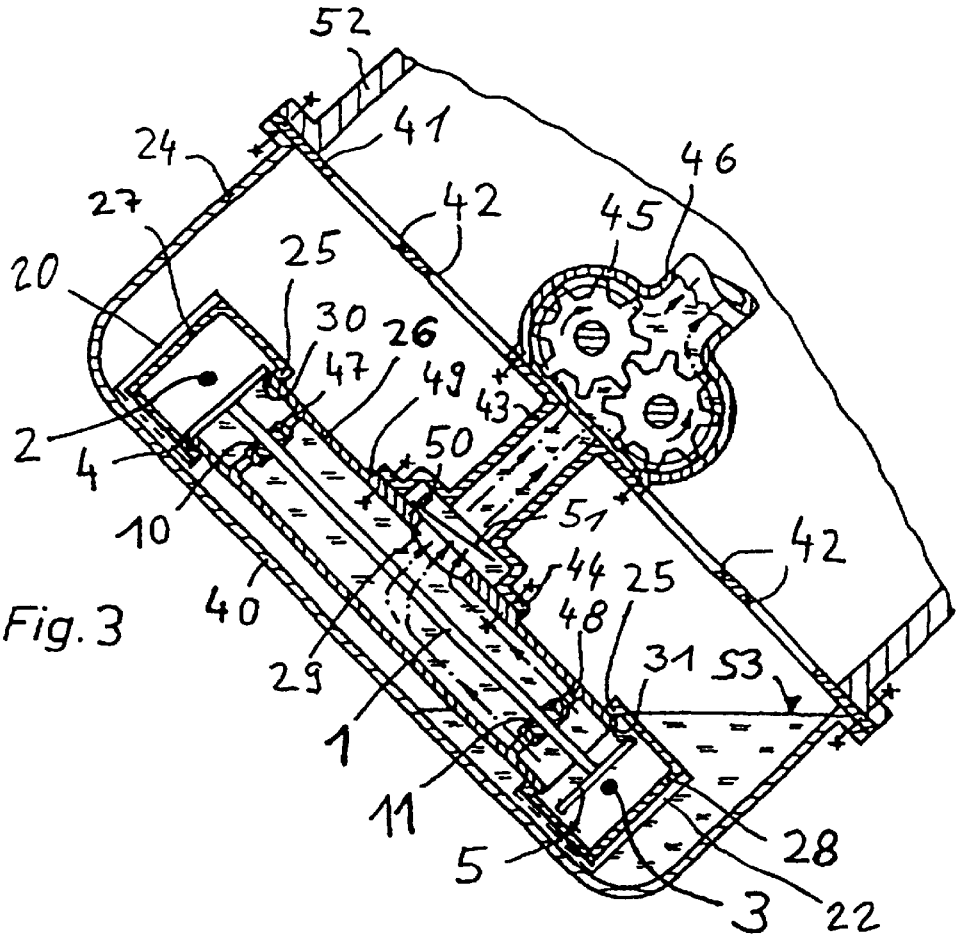
Fig. 3

OIL PICKUP SYSTEM FOR AN INTERNAL COMBUSTION ENGINE, NOTABLY A SINGLE-CYLINDER DIESEL ENGINE

The invention relates to an oil-pickup system for an internal combustion engine according to the preamble of claim 1.

An important criterion for the maximum permissible inclination during operation of internal combustion engines is the lubricating-oil system. If the inclination of the internal combustion engine exceeds a critical value, it is important to prevent the oil pump from sucking in air and the propulsion-unit components disposed at the bottom of the crankcase from churning in the oil, which would lead to heating of the lubricating oil and would also hinder the return flow of oil, for example from the valve-lifter housing to the oil pan. Finally, at steep inclinations, oil can travel through the crankcase vents into the combustion-air intake system, which in the extreme case could cause engine damage in diesel engines because of a speed increase that can no longer be controlled.

Extreme inclinations of internal combustion engines occur, for example, when they are used for motor-vehicle drives. In this area attempts have been made to avoid the problems mentioned hereinabove by lowering the oil level by means of a deeper oil pan. It was indeed possible largely to avoid the cited disadvantages by particularly deep oil pans. Such special oil pans, however, cause high manufacturing costs and limit the use of the engine because of its greater space requirement.

In a known oil-pickup system (German Laid-open Application DE-OS 2339730) of the type mentioned in the introduction, the control valves are disposed at the inside ends of the respective oil-pickup tubes, or in other words close to the center of the oil pan. The danger therefore exists that the control valves will respond only after a delay, and so intake of residual air flows has to be tolerated.

The object of the present invention is therefore to provide an oil-pickup system which avoids the foregoing disadvantages and which in particular responds sufficiently sensitively to avoid intake of air reliably even at steep inclinations.

This object is achieved by an oil-pickup system with the features of claim 1. Advantageous embodiments are described in the dependent claims.

According to the invention, the oil-pickup system is provided with at least three oil-pickup tubes having at least four pickup heads, which are in communication with the oil pump via a suction tube and which are disposed in the oil pan in such a way that, when the internal combustion engine is in inclined position, intake of air is prevented by control valves disposed in the oil-pickup tubes. Those control valves are open during "normal" horizontal position of the oil pan. At extreme inclination of the oil pan, however, only the control valves wetted with oil are open. All other control valves remain closed. The oil-pickup system according to the present invention can be easily retrofitted to existing internal combustion engines, since it is merely necessary to detach the oil pan and the normal suction strainer and replace the latter by the oil-pickup system according to the present invention. Adjustment of the control valves can be accomplished mechanically or by other suitable means.

By the fact that the control valves in the present invention are provided with valve plates disposed to slide along slide rods under the effect of gravity and with valve seats disposed at the tube ends, there is achieved simple but nevertheless sensitively responding mechanical gravity control of the valves. In addition to the desired automatic open and closed positions of the control valves, depending on inclination, this gravity control also has a "fail-safe" function, since simultaneous closing of all valves is reliably prevented by the fact that two valve plates are disposed on a common slide rod.

One advantageous embodiment of the invention provides that three oil-pickup tubes are disposed in the form of an "H", each of the two side tubes being provided with two pickup heads. This arrangement ensures that sufficient oil to ensure pickup of oil without air is present in at least one corner of the oil pan, regardless of tilt position. The suction tube can be disposed centrally, for example, between the two side tubes, by means of a flange to the connecting tube.

Further advantageous embodiments of the inventive oil-pickup system can be formed by arranging the oil-pickup tubes in the form of an "X", "Z" or rectangle. What is important in each case is that at least one pickup head be present at all corners of the oil pan where the oil level can collect during inclined positions. Depending on the geometry of the oil pan, this may also be possible, for example, by a triangular, polygonal or star-shaped arrangement of oil-pickup tubes.

A further advantageous embodiment of the present invention provides that the pickup heads are provided with a pickup opening directed toward the pan bottom. Without such a structural geometry, a minimum oil level corresponding to the size of the tube diameter would have to be present to avoid intake of air. An even lower oil level is possible only with the oil-pickup openings disposed at the bottom, as in the advantageous embodiment.

In yet another advantageous embodiment, filter screens are disposed on the pickup heads. Hereby intake of impurities present in the oil sump is prevented.

A final advantageous embodiment provides that a non-return valve is disposed at the junction between suction tube and oil-pump seat, in order to prevent the suction-tube and pump spaces from running empty when the engine is stopped.

A practical example of the present invention will be described hereinafter with reference to the attached drawings, wherein:

FIG. 2 shows a schematic side view from direction A—A in FIG. 1 in section, the oil pan being in horizontal position, and FIG. 3 shows a view according to FIG. 2, but with the oil pan tilted.

Figure 1:
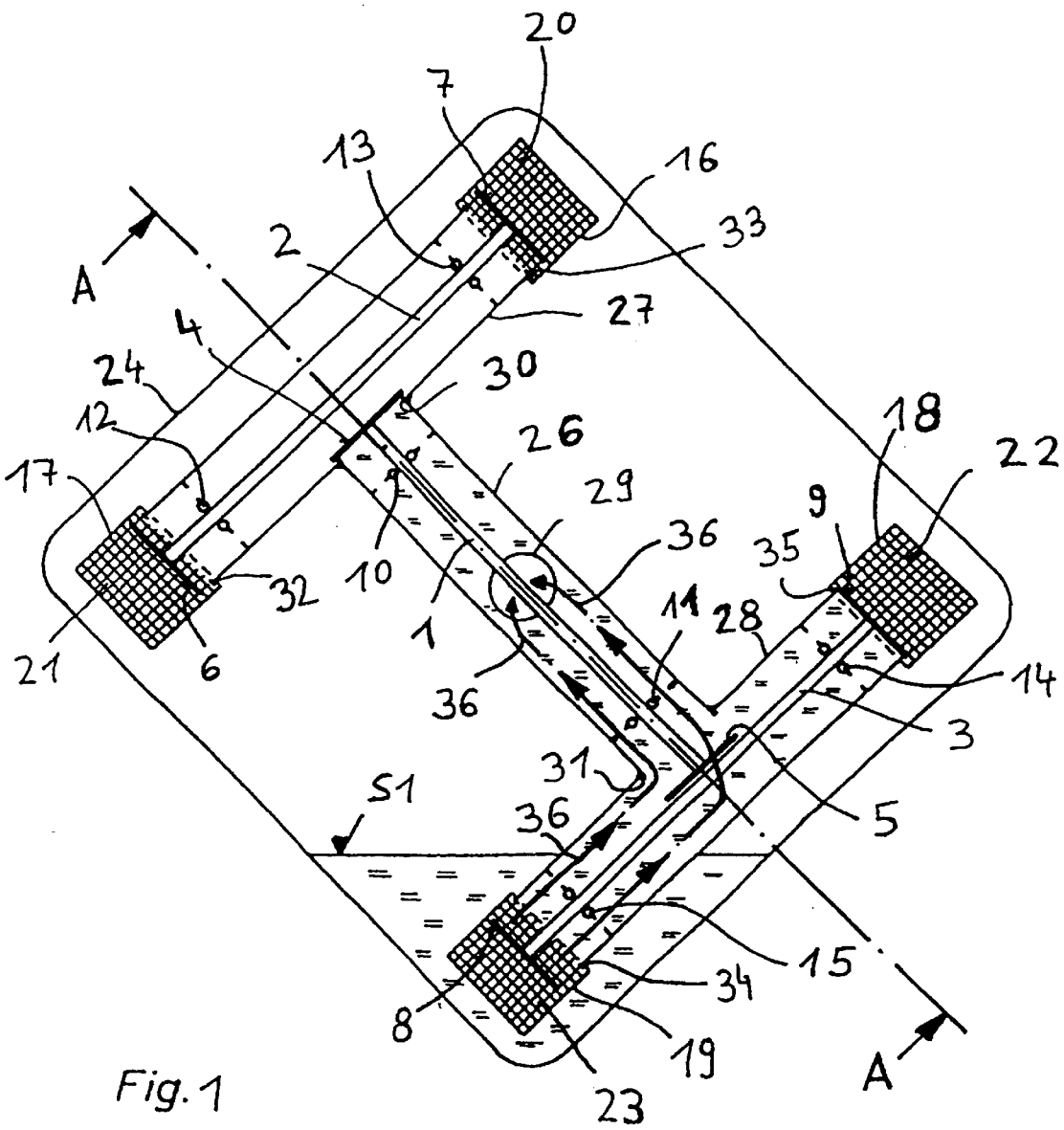
FIG. 1 shows a schematic top view of an oil-pickup system according to the present invention in section.

FIG. 1 illustrates an embodiment of an inventive oil-pickup system mounted in an oil pan 24. As illustrated, oil pan 24 is disposed in inclined position, and so oil level S1 washes only around pickup head 19 of tube 28. The oil-pickup system, which is configured in the form of an "H", comprises in total three oil-pickup tubes 26, 27, 28, each of which is provided with a slide rod 1, 2, 3 mounted to slide axially, on the two ends of which there are disposed valve plates 4, 5, 6, 7, 8, 9 respectively. In the illustrated orientation the valves of oil-pickup tube 27 are open, although they are not wetted by oil. To prevent intake of air, the valve of tube 26 comprising valve plate 4 and valve seat 30 is closed, and the valve disposed at the other end of the slide rod and comprising valve plate 5 and valve seat 31 is open.

In this arrangement valve rod 1 is mounted to slide axially over axial bearings 10, 11. As already mentioned, oil pickup tube 28 is provided with the open control valve comprising valve plate 8 and valve seat 34 as well as with the closed control valve comprising valve plate 9 and valve seat 35. The two valve plates 8, 9 are joined by axially slidable slide rod 3, which is mounted movably in bearings 14, 15. The two side tubes 27, 28 are further provided with filter screens 20, 21, 22, 23. Bearings 12, 13 of slide rod 2 in tube 27 are also illustrated. Valve plates 6, 7 with valve seats 32, 33 are disposed at the ends of slide rod 2.

The oil flow is illustrated in FIG. 1 by arrow 36. Also illustrated in FIG. 1 is outlet opening 29, which is disposed centrally on the top side of suction tube 26 and is in communication with suction tube 43, not shown, to oil pump 45, also not shown. In the illustrated inclined position, valve plates 5 and 8 move under gravity to their open positions, while valve plates 4 and 9 are shifted by slide rods 1 and 3 into their closed positions. Hereby it is ensured that no air is sucked into the pickup system, which now is open only at pickup head 19. The position of the valves in oil-pickup tube 27 is immaterial in the inclined position illustrated in FIG. 1, since tube 27 is completely isolated from the rest of the oil-pickup system and thus in particular from outlet opening 29 by closed valve plate FIG. 2 schematically shows the oil-pickup system from FIG. 1 in lateral section, oil pan 24 fastened to crankcase 52 being disposed in horizontal position, meaning that oil level S2 is parallel to pan bottom 40. In this position valve plates 4,5 of tube 26 are both open, or in other words lifted from valve seats 30, 31. Tubes 27 and 28, which are in communication with tube 26 via flange 25, are illustrated in section, as are slide rods 2, 3. Moreover, both valves in both side tubes 27, 28 are open, and so oil is being sucked in via all four pickup heads 16, 17, 18, 19. Between crankcase 52 and oil pan 24 there is further fastened a support plate 41, which has a plurality of openings 42 which permit unhindered flow of oil. Plate 41 is provided at the center with a suction tube 43 for an oil-delivery pump 45, which in the diagram is a gear pump, the case of which is fastened to plate 41. The oil delivered by pump 45 to the consuming points of the engine passes into a pressure tube 46. At the lower end, suction tube 43 is constructed as a flange 44, which is used for fastening a long, hollow and cylindrical tube 26 running parallel to bottom 40 of pan 24. For this purpose tube 26 is provided with a fastening flange 49. Inside flange 44 there is provided on a pin 50 a tiltable plate valve 51, which bears sealingly on flange 49 when the engine is stopped and prevents return flow of oil from suction tube 43 and pump 45. A slide rod 1 is mounted to slide parallel to the axis in tube 26. To ensure the necessary smooth travel of rod 1 during its sliding movement, there are provided two bearings 10, 11, such as ball bearings, in two perforated transverse flanges 47, 48 of tube 26. Rod 1 carries at one end a plane valve plate 4, 5, which cooperates respectively with an annular face formed as valve seat 30, 31 at the two ends of tube 26.

FIG. 3 shows the oil-pickup system according to FIG. 2, but in tilted position, so that oil level S3 is located in the right lower corner. This situation occurs, for example, when a vehicle is climbing a steep slope and oil pan 24 assumes a position inclined at an angle of about $^{45}$E to the horizontal. The oil collects in the right lower corner of oil pan 24, and oil level S3 is again horizontal. Under the effect of gravity, rod 1 occupies the position illustrated in FIG. 2, in which valve plate 5 is moved away from valve seat 31 and the oil supply to pump 45 flows through tube 28, which is completely immersed in oil, and pickup heads 18, 19 disposed thereon. Even in this extreme inclined position of a vehicle, oil pump 45 and thus also oil pan 24 of the internal combustion engine can suck in only oil and not any air.

What is claimed is:

1. An oil-pickup system for an internal combustion engine, especially a one-cylinder diesel engine, which system is provided with an oil pan and an oil pump, wherein the pickup system is provided with at least three oil-pickup tubes having at least four pickup heads, which are in communication with the oil pump via a suction tube and which are disposed in the oil pan in such a way that, when the internal combustion engine is in inclined position, intake of air is prevented by control valves disposed in the oil-pickup tubes, and wherein the control valves are actuated by slide rods (1, 2, 3) which slide under the effect of gravity, characterized in that the control valves comprise valve plates (4, 5, 6, 7, 8, 9) which cooperate with valve seats (30, 31, 32, 33, 34, 35) disposed at the ends of the tubes.

2. An oil-pickup system according to claim 1, characterized in that three oil-pickup tubes (26, 27, 28) are disposed in the form of an "H" and the two side tubes (27, 28) are each provided with two pickup heads (16, 17, 18, 19).

3. An oil-pickup system according to claim 1, characterized in that the oil-pickup tubes are disposed in the form of an "X", "Z" or rectangle.

4. An oil-pickup system according to claim 1, characterized in that the pickup heads (16, 17, 18, 19) are provided with a pickup opening directed toward the pan bottom (40).

5. An oil-pickup system according to claim 1, characterized in that filter screens (20, 21, 22, 23) are disposed on the pickup heads (16, 17, 18, 19).

6. An oil-pickup system according to claim 1, characterized in that a nonreturn valve (29, 51) is disposed between suction tube and oil pump, in order to prevent the suction-tube and pump spaces from running empty when the engine is stopped.

* * * * *